US007290757B2

(12) United States Patent
Horikawa et al.

(10) Patent No.: US 7,290,757 B2
(45) Date of Patent: Nov. 6, 2007

(54) ROTARY CARBURETOR

(75) Inventors: Takashi Horikawa, Natori (JP); Teruhiko Tobinai, Sendai (JP)

(73) Assignee: Walbro Engine Management, L.L.C., Tucson, AZ (US)

( * ) Notice: Subject to any disclaimer, the term of this patent is extended or adjusted under 35 U.S.C. 154(b) by 0 days.

(21) Appl. No.: 11/324,935

(22) Filed: Jan. 4, 2006

(65) Prior Publication Data

US 2006/0151893 A1 Jul. 13, 2006

(30) Foreign Application Priority Data

Jan. 11, 2005 (JP) ..... 2005-003355
Mar. 14, 2005 (JP) ..... 2005-070771

(51) Int. Cl.
*F02M 9/08* (2006.01)

(52) U.S. Cl. ..... 261/44.6; 261/44.8; 261/45; 261/54; 261/63; 261/DIG. 1

(58) Field of Classification Search ..... 261/44.6–44.8, 261/45–47, 54–56, 63, DIG. 1
See application file for complete search history.

(56) References Cited

U.S. PATENT DOCUMENTS 5,709,822 A * 1/1998 Togashi ..... 261/44.2
6,769,670 B2 * 8/2004 Ohgane et al. ..... 261/44.6
6,945,520 B2 * 9/2005 Ohgane et al. ..... 261/44.6
6,983,928 B2 * 1/2006 Araki ..... 261/34.2
2003/0111743 A1 * 6/2003 Ohgane et al. ..... 261/44.8
2004/0251565 A1 * 12/2004 Douyama et al. ..... 261/44.3
2005/0173814 A1 * 8/2005 Horikawa et al. ..... 261/44.6

FOREIGN PATENT DOCUMENTS

JP 64-63641 A * 3/1989 ..... 261/44.8

* cited by examiner

*Primary Examiner*—Richard L. Chiesa
(74) *Attorney, Agent, or Firm*—Reising, Ethington, Barnes, Kisselle, P.C.

(57) ABSTRACT

A versatile rotary carburetor has an idle adjustment needle, a high speed adjustment needle, and preferably an air bypass screw which are substantially parallel to one another and are axially exposed for adjustment in a substantially common direction. Preferably a cammed rotary throttle valve is seated in a body of the carburetor for rotation about and axial movement along an axis. The rotary throttle valve intersects a mixing passage in the body, and carries a through-bore that variably generally aligns to the mixing passage upon rotation of the throttle valve. The throttle valve projects axially through an external surface of the body and threadably receives the idle adjustment needle oriented concentrically to the axis. A primary fuel feed tube disposed concentrically to the axis projects into the through-bore to receive the idle adjustment needle at an open distal end which variably obstructs an orifice in a cylindrical wall of the tube that generally communicates with the through-bore for delivering liquid fuel to the mixing passage. The high speed adjustment needle is preferably threaded to the body for adjustably intersecting and obstructing a fuel passage in the body that flows liquid fuel to the fuel feed tube for the flow of liquid fuel. Preferably, the air bypass screw threads into the body for adjustably intersecting and obstructing an air bypass passage in the body communicating at both ends with the mixing passage for generally bypassing the rotary throttle valve when in an idle position.

25 Claims, 6 Drawing Sheets

ROTARY CARBURETOR

RELATED APPLICATIONS

Applicants claim priority of Japanese Application Ser. No. 2005-070771 filed on Mar. 14, 2005 and Japanese Application Ser. No. 2005-003355 filed on Jan. 11, 2005.

FIELD OF THE INVENTION

The present invention relates generally to a carburetor for a combustion engine and more particularly to a rotary carburetor.

BACKGROUND OF THE INVENTION

Known rotary type carburetors are commonly used for small, two stroke combustion engines applied to applications such as handheld chainsaws, leaf blowers, hedge trimmers, and the like. A rotary throttle valve of the carburetor has a generally cylindrical throttle received rotatably in a cylindrical cavity of a body that intersects a fuel-and-air mixing passage extending through the body. The rotary throttle valve rotates about an axis and, via a cam interface between the body and the cylindrical throttle, is also operatively moveable axially within the cylindrical cavity. The axial position of the cylindrical throttle is thus dependent upon the rotational angular placement of the throttle valve between a closed or idle position and a wide open throttle, WOT, position. A through-bore extends transversely through the cylindrical throttle of the rotary throttle valve and variably aligns generally longitudinally with the fuel-and-air mixing passage. The through-bore extends substantially perpendicular to the rotary axis and aligns so that when the carburetor is in the WOT position the through-bore is in substantially full communication with the fuel-and-air mixing passage, and when the through-bore is substantially misaligned or communicating minimally with the mixing passage the rotary throttle valve is either closed or in the idle position.

A fuel feed tube disposed concentrically to the rotary axis projects upward from the body and into the through-bore of the cylindrical throttle to an open distal end. An idle adjustment needle is fixedly attached to and projects downward from the cylindrical throttle, into the through-bore, and through the open distal end of the fuel feed tube. An orifice or jet for flowing liquid fuel into the through-bore communicates through a wall of the fuel feed tube and variably aligns axially with the idle fuel adjustment needle in the tube thereby varying the flow cross section of the orifice. Because the rotating cylindrical throttle is cammed, it moves axially during rotation carrying the idle fuel adjustment needle with it as the fuel feed tube and orifice remain stationary. The flow cross section of the orifice generally increases as the throttle valve moves toward the WOT position.

The idle fuel adjustment needle is threaded to the cylindrical throttle enabling adjustment of the quantity of liquid fuel entering the through-bore generally at idle operating conditions of the engine. When the idle fuel adjustment needle is threaded further into the cylindrical throttle more of the orifice is obstructed thus the flow of liquid fuel through the orifice and into the through-bore is reduced. During engine high speed operation or WOT, the idle fuel adjustment needle has little to no effect on fuel flow through the orifice. Instead, a separate high speed fuel adjustment needle is utilized. The high speed fuel adjustment needle threads into the body of the carburetor to adjustably obstruct a primary fuel feed passage in the body that flows liquid fuel to the fuel feed tube. By threading the high speed fuel adjustment needle further into the body, more of the passage is obstructed and less fuel flows through the orifice of the fuel feed tube at high engine speeds.

During manufacturing assembly of the rotary carburetor, and presuming the valve axis is vertical for purposes of explanation, the cylindrical cavity is typically opened upward for receipt of the rotary throttle and is aligned and supported axially between a bottom of the cylindrical cavity carried by the body and a top cover fastened to the body. A hollow shaft of the rotary throttle disposed concentrically to the rotary axis projects rigidly from the throttle and through the cover to engage a throttle lever having a hole for access to the idle fuel adjustment needle located inside the shaft. Unfortunately, access to the high speed adjustment needle must be provided on the side of the carburetor body and not the top like the idle adjustment needle because the top is generally congested with the cover, throttle lever and cam mechanism of the carburetor. Moreover, the fuel passage leading to the fuel nozzle is located centrally in the carburetor main body, and the high speed adjustment needle must extend into the fuel passage in an axially moveable manner with respect to the passage.

Therefore, when conducting the idle and high speed calibration and operation tests of the carburetor in the assembly line or at the time of servicing, the adjustment must be conducted from two different directions, and this inconveniently complicates the adjustment work. Furthermore, when the carburetor is mounted on the engine, it is necessary to provide access for adjustment of the carburetor from two different directions and locations. This restricts the layout of other auxiliary equipment and component parts.

SUMMARY OF THE INVENTION

A versatile rotary carburetor has an idle adjustment needle, a high speed adjustment needle, and preferably an air bypass screw mounted for adjustment externally of the carburetor and that are substantially parallel to one-another and accessible for adjustment from a common direction. The idle adjustment needle preferably threads adjustably into a cylindrical throttle projecting outward from the external surface. The cylindrical throttle is rotatable about and movable along an axis in a cylindrical cavity of the body. The cylindrical cavity intersects a fuel-and-air mixing passage in the body that delivers a controlled mixture of fuel and air to the running engine. A primary fuel feed tube disposed concentrically to the rotary axis projects into a through-bore in the cylindrical throttle which is orientated to adjustably align to the mixing passage as the cylindrical throttle rotates. The idle adjustment needle projects axially into the primary fuel feed tube for variably obstructing an orifice in a cylindrical wall of the tube that generally communicates with the through-bore for delivering liquid fuel to the mixing passage. The cylindrical throttle is preferably cammed to move axially as the throttle rotates thereby moving the idle adjustment needle in and out of the fuel feed tube and varying the flow cross section of the orifice.

The high speed adjustment needle is preferably threaded to the body for adjustably intersecting and obstructing a fuel passage in the body that communicates between a fuel source and the fuel feed tube for the flow of liquid fuel into the mixing passage. Preferably, the air bypass screw threads into the body for adjustably intersecting and obstructing an air bypass passage in the body communicating with the mixing passage at both ends and generally bypassing the rotary throttle valve for adjustable air flow into the mixing passage generally downstream of the rotary throttle valve during engine idling.

Preferably, the body has a base portion that carries an external surface and the mixing passage, and has an opposite face that sealably attaches to a fuel metering chamber assembly that supplies liquid fuel at a controlled pressure to the fuel feed tube. The fuel metering chamber assembly is preferably constructed to be removed from the base portion as a single unit, and when removed, exposes the cylindrical cavity that is open through the face of the base portion for receipt of the throttle during assembly. Preferably, the fuel feed tube is attached rigidly to the fuel metering chamber assembly or is otherwise supported by and is removable from the throttle when the fuel metering chamber assembly is detached from the base portion of the body.

Objects, features and advantages of this invention include a carburetor with multiple adjustments that are all adjustable from a single direction improving packaging versatility for an engine application. Other advantages include simplified manufacturing assembly, improved work efficiency when adjusting fuel and air flow through the carburetor, and easy disassembly for cleaning and maintenance of internal components such as the fuel feed tube while protecting and making other components less susceptible to damage. The carburetor is of relatively simple design, economical manufacture and assembly robust, reliable, durable and in service has a long useful life.

BRIEF DESCRIPTION OF THE DRAWINGS

These and other objects, features and advantages of this invention will be apparent from the following detailed description, appended claims, and accompanying drawings in which:

DETAILED DESCRIPTION OF THE PREFFERED EMBODIMENTS

Figure 1:
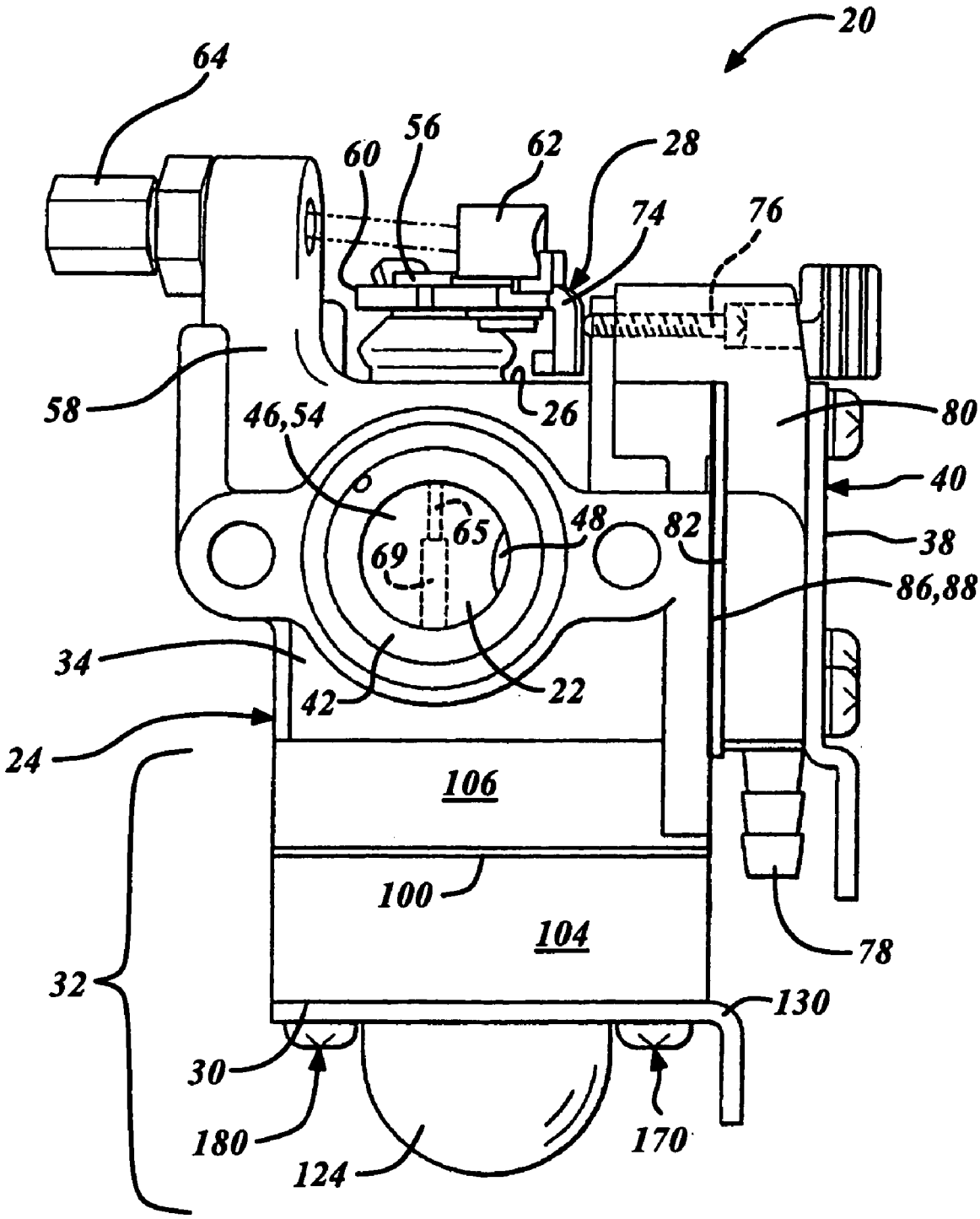
FIG. 1 is a front view generally of a rotary carburetor embodying the invention.

As best illustrated in FIGS. 1-4, a diaphragm carburetor 20 embodying the present invention is preferably of a rotary type and has a fuel-air mixing passage 22 extending through a main body 24 for the flow of a mixture of fuel and air to a running combustion engine. As illustrated and orientated for the sake of explanation, the main body 24 has an external top surface 26 through which a rotary throttle valve 28 projects and exposes a fuel idle adjustment needle 65 for operator access and adjustment. Also accessible through or above the top surface 26 is a fuel high speed adjustment needle 27, and preferably an air bypass screw 160 and an idle adjustment screw 76. Having generally all of the carburetor adjustments located on one surface or side of the carburetor body 24, increases versatility of carburetor packaging in an engine driven apparatus, simplifies end user or operator adjustments and improves manufacturing assembly and efficiency.

The main body 24 also has an external bottom surface 30 receiving a fuel metering chamber assembly 32, a front end 34 with an inlet opening of the mixing passage 22, an opposite rear end 36 with an outlet opening of the mixing passage 22, and a flanking side 38 spanning horizontally between the front and rear ends 34, 36 and vertically between the top and bottom surfaces 26, 30. Preferably, the flanking side 38 is generally carried by a fuel pump assembly 40 for delivering pressurized fuel to the metering chamber assembly 32, and the rear end 36 of the main body 24 mounts to a combustion engine (not shown).

The mixing passage 22 is divided into upstream and downstream regions 42, 44 by the intersection of the throttle valve 28 received in a cylindrical cavity 48 carried by a base portion 58 of the body 24. A cylindrical throttle or barrel 46 of the rotary throttle valve 28 is received in the cylindrical cavity 48 for rotation about, and axial movement along, an axis 50 disposed substantially perpendicular to the mixing passage 22. A through-bore 52 extends laterally through the cylindrical throttle 46 and, dependent upon the rotational angle, adjustably aligns generally longitudinally to the mixing passage 22 between a closed position that substantially isolates the upstream region 42 from the downstream region 44, and a wide open throttle position that provides maximum communication between the regions through the through-bore 52.

The cylindrical throttle 46 preferably has a relatively large diameter cylinder base member 54 carrying the through-bore 52 and a relatively small diameter coaxial and substantially hollow shaft or stem 56 that projects through and outward from the top surface 26. The shaft 56 is preferably unitary to, or formed in one piece with, the base member 54 and attaches to a throttle lever 60 of the rotary throttle valve 28 at a distal end located externally from the body 24. A connecting member 62 is preferably journalled for rotation to a distal end of the lever 60 disposed radially outward from the shaft 56 for engagement to an end of a linkage or wire of a Bowden cable 64 for remote control of the rotary throttle valve 28.

The lever 60 has a hole 63 concentric with the axis 50 providing access to a preferably slotted head of a fuel idle adjustment needle 65 by a tool 67 such as a screwdriver. The idle adjustment needle 65 is preferably threaded to the inside of the hollow shaft 56 and projects downward along the axis 50 and transversely into the through-bore 52 of the throttle 46. An open distal end of a fuel feed tube 69 receives a distal end or tip of the idle adjustment needle 65 and projects upward along the axis and transversely into the through-bore 52. The fuel feed tube 69 receives liquid fuel from the fuel metering chamber assembly 32 and expels the fuel into the through-bore through a fuel jet or orifice 71 located in the cylindrical wall of fuel feed tube 69, and being adjustably and variably obstructed by the internal idle adjustment needle 65.

Preferably, the rotary throttle valve 28 is biased closed by at least a coiled compression spring 66 disposed about the shaft 56 and compressed axially between an upper underside 68 of the machined base portion 58 of the body 24 and the base member 54 of the cylindrical throttle 46. A cam interface 70 located between a distal, contoured or ramped end 61 of the base member 54 of the cylindrical throttle 46 and a ramped bottom face 72 of the cylindrical cavity 48 that is carried by the body 24, and in conjunction with the axial force of the spring 66, urges the rotary throttle valve 28 toward the closed or idle position. The rotary throttle valve 28 rotates preferably toward the open position and moves axially upward against the biasing force of the spring 66 when actuator wire of the Bowden cable 64 is pulled, and the valve automatically rotates and moves axially downward toward the biased closed position when the Bowden cable is released under the return force of the spring 66 and the cam interface 70. Because the cylindrical throttle 46 is preferably cammed to move axially as the throttle rotates, the idle adjustment needle 65 also moves axially in and out of the fuel feed tube 69 as the rotary throttle valve 28 rotates. Hence, the idle adjustment needle 100 variably obstructs an orifice 71 in the cylindrical wall of the tube 69 that generally communicates with the through-bore 52 for delivering liquid fuel to the mixing passage 22.

Figure 3:
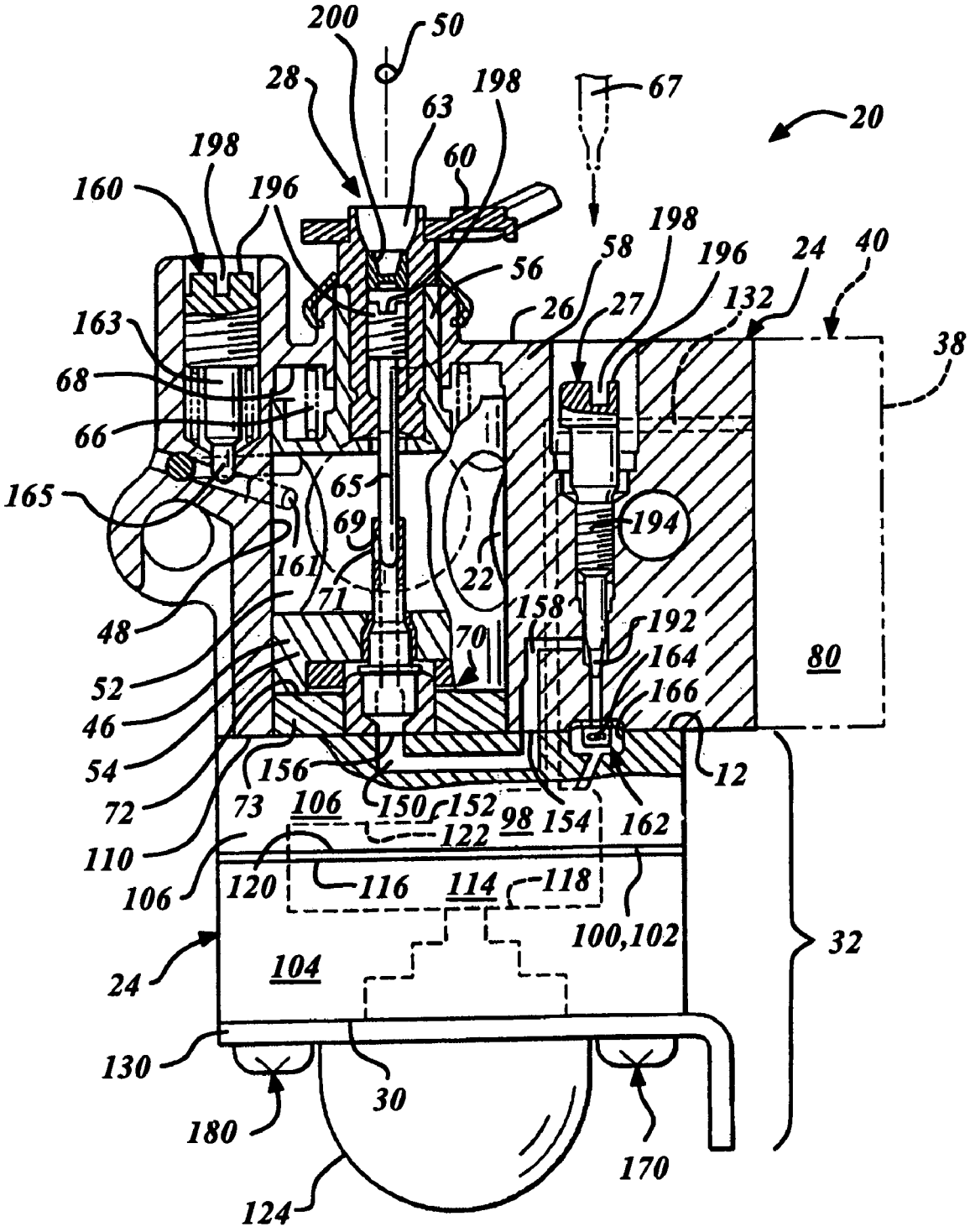
FIG. 3 is a sectional view of the rotary carburetor taken along line 3-3 of FIG. 2.

As best illustrated in FIG. 3, the bottom face 72 is preferably carried by an annular bottom collar 73 of the body 24 that is engaged and disposed substantially concentrically to a base end of the fuel feed tube 69. For manufacturing assembly operations which insert the rotary throttle valve 28 into the cylindrical cavity 48 from the bottom, the collar 73 is generally separate from the base portion 58 of the main body 24, snugly fits into and is rotationally indexed or fixed in the cylindrical cavity 48 and is supported or carried by the fuel metering chamber assembly 32. Alternatively, for manufacturing assembly operations which insert the rotary throttle valve 28 into the cylindrical cavity 48 from the top, the collar 73 is preferably unitary to the base portion 58 of the main body 24, as best illustrated in FIGS. 5 and 6.

Figure 2:
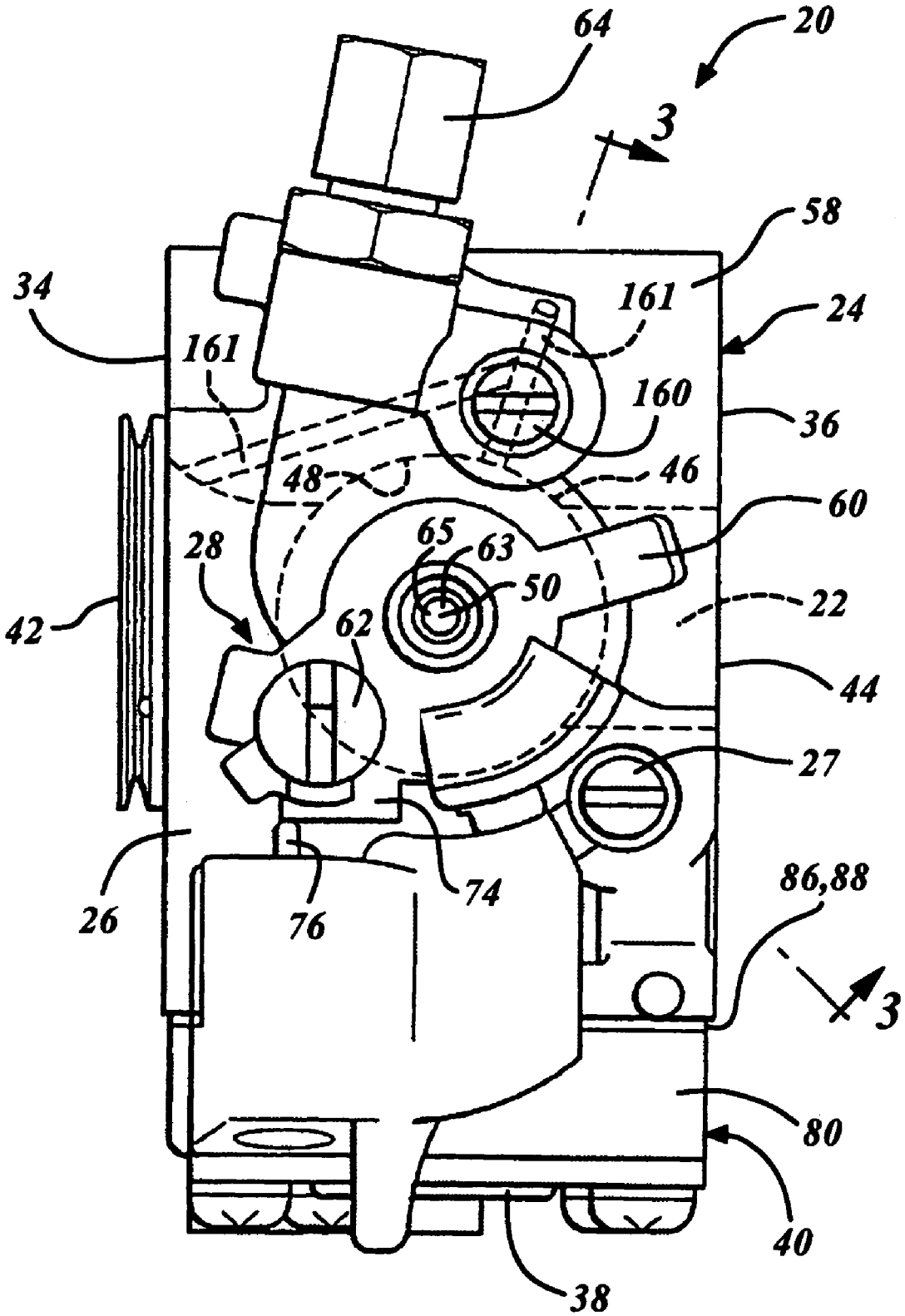
FIG. 2 is a top view of the rotary carburetor.
Figure 5:
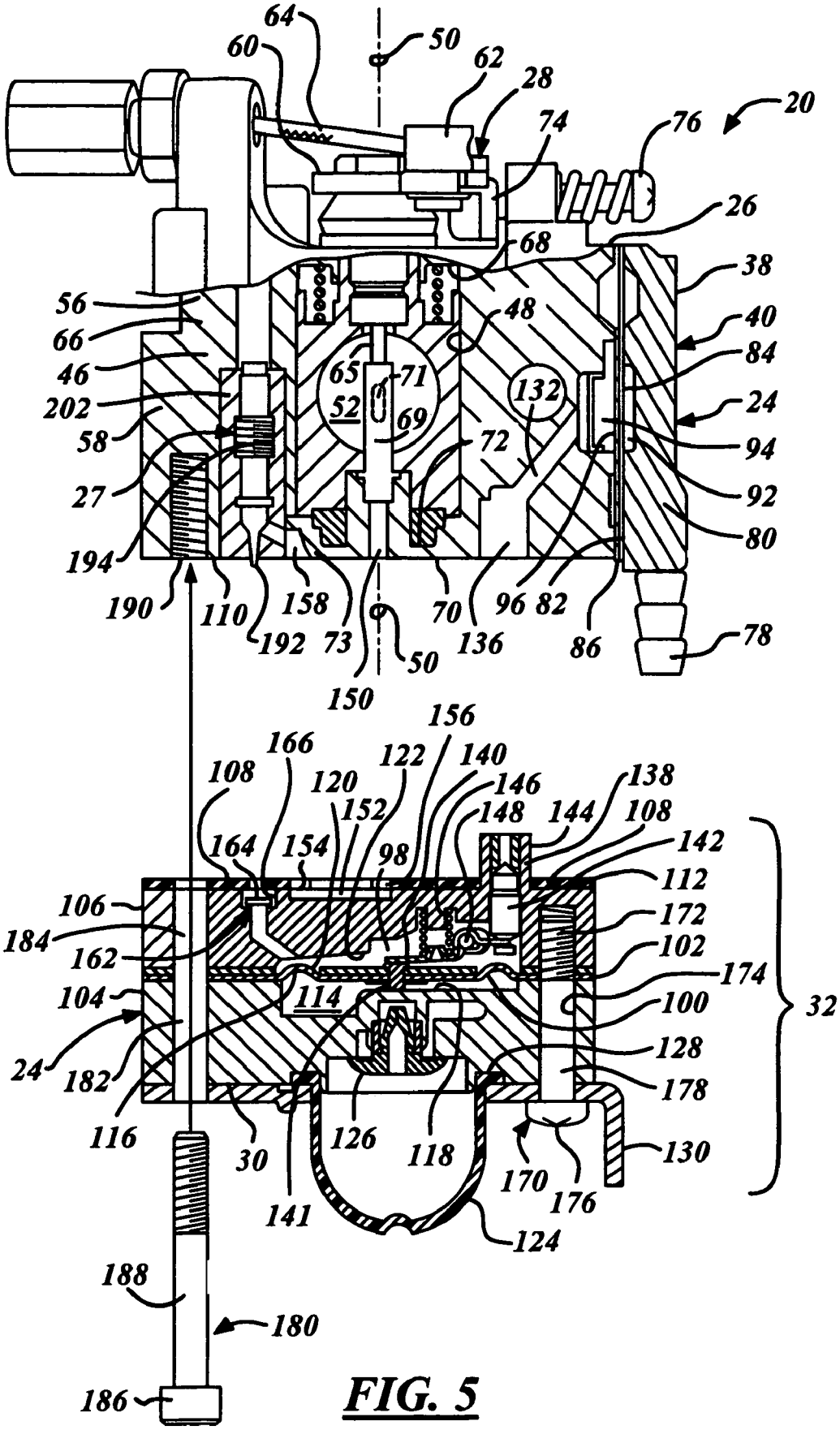
FIG. 5 is a fragmentary, exploded, cross sectional view of a modification of the rotary carburetor.
Figure 6:
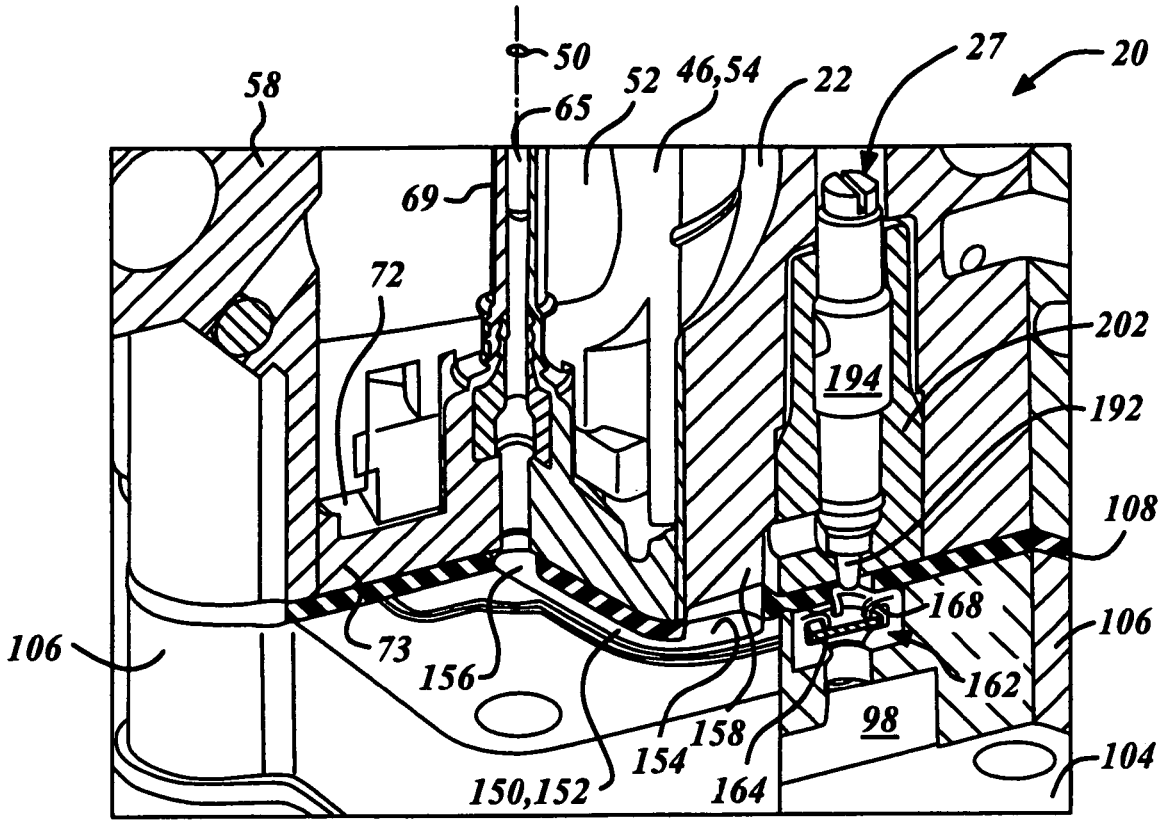
FIG. 6 is a fragmentary perspective, sectional view of the modified rotary carburetor of FIG. 5 illustrating a fuel channel intersected by a high speed adjustment needle of the rotary carburetor.

As best illustrated in FIGS. 1, 2 and 5, the lever 60 of the rotary throttle valve 28 carries a bent tab 74 orientated substantially perpendicular to the top surface 26 and spaced radially outward from the axis 50. Preferably, the tab 74 is formed by bending a peripheral portion of the lever at a right angle. The spring loaded idle adjustment screw 76 is supported by and preferably threaded to the base portion 58 of the body 24 at about a right angle to the axis 50 for adjustably abutting the bent tab 74 thereby restricting rotation of the rotary throttle valve 28 toward the biased closed position and enabling adjustment of this idle slightly open position of the rotary throttle valve 28. As an alternative, one skilled in the art would now understand that the adjustment screw 76 could also be threaded into the fuel pump assembly 40 in applications where packaging requirements so dictate.

The fuel metering chamber assembly 32 and the fuel pump assembly 40 are generally integrated into the main body 24 of the rotary carburetor 20, are of layered construction, and are disposed generally perpendicular to one another. The carburetor 20 receives liquid fuel preferably from a fuel source such as an on-board fuel tank of an engine-driven apparatus (not shown) and through a barbed connector 78 projecting downward from a side plate 80 of the pump assembly 40 that carries the flanking side 38 of the main body 24. An internal face 82 of the side plate 80 generally disposed opposite the flanking side 38 faces a dry side 84 of a resiliently flexible pump diaphragm 86 having a peripheral edge 88 sealed between an outward face 90 of the base portion 58 and the internal face 82 of the side or flanking plate 80 of the body 24. A pulsating pressure chamber 92 is defined between the internal face 82 of the side plate 80 and the dry side 84 of the diaphragm 86 and communicates typically with a crankcase of the combustion engine (not shown). A pump chamber 94 is defined between an opposite wet side 96 of the pump diaphragm 86 and the outward face 90 of the base portion 58 of the main body 24.

From the pump chamber 94, the pump assembly 40 flows pressurized liquid fuel through a fuel channel 98 in the base portion 58 of the main body 24 and to a metering chamber 98 of the fuel metering chamber assembly 32. The fuel metering chamber assembly 32 has a resiliently flexible, and preferably convoluted, metering diaphragm 100 separating a fuel metering chamber 98 from at atmospheric or reference chamber 114 vented preferably to the atmosphere. The metering diaphragm 100 is generally received between and sealed along a peripheral edge 102 to an external bottom plate 104 of the main body 24 that preferably carries the bottom surface 30, and a mid plate 106 of the main body 24 engaged sealably to the base portion 58. Preferably, gaskets or O-rings 108 provide the necessary sealing between a downward face 110 of the base portion 58 and an upward face 112 of the mid plate 84. The reference chamber 114 of the fuel metering chamber assembly 32 is defined between an opposite dry side 116 of the metering diaphragm 100 and an upward face 118 of the bottom plate 104, and the metering chamber 98 is defined between a wet side 120 of the metering diaphragm 100 and an opposite downward face 122 of the mid plate 106.

A manual prime or purge pump with a flexible bulb 124 of the fuel metering chamber assembly 32 operates in a manner commonly known in the art and has a two-way umbrella valve 126. A peripheral edge 128 of the purge bulb 124 engages sealably between the downward bottom surface 30 of the bottom plate 104 of the main body 24 and a bottom bracket 130.

In operation with the engine running, pressure pulses from the crankcase of the engine are received in the pressure chamber 92 of the pump assembly 40 causing the pump diaphragm 86 to flex into and out of the pressure chamber 92. As the diaphragm 86 flexes into the pressure chamber 92 fuel flows from the remote fuel tank or fuel source, through the connector 78 and corresponding passage 126 and into the expanding pump chamber 94. The passage 126 thereby provides fluid communication between the side plate 80 and the base portion 58 of the body 24 and is interposed by an inlet check valve (not shown) that allows fuel flow into the pump chamber 94 and prevents the back-flow of fuel into the fuel tank. Preferably, the check valve is generally located between the side plate 80 and the base portion 58.

As the pump diaphragm 86 flexes back toward the pump chamber 94 with increasing pressure in the crankcase, the volume of the pump chamber 94 decreases causing displaced fuel to flow through an outlet check valve (not shown) that is generally in a fuel channel 132 that intermittently communicates with the metering chamber 98 through a fuel regulating or metering valve 134 that closes when a sufficient fuel pressure or fuel volume is reached in the metering chamber 98.

As best illustrated in FIG. 5, the fuel regulating valve 134 is located in the fuel metering chamber 98 and is supported by the mid plate 106. The fuel channel 132 is substantially in the base portion 58 of the main body 24. As illustrated in FIGS. 3 and 5, the fuel channel 132 communicates between the pump chamber 94 and the metering chamber 98 of the fuel metering chamber assembly 32. In the modified carburetor 20 of FIG. 5, the channel 132 communicates with a bore 136 in the base portion 58 that opens through the downward face 110 of the base portion 58. A cylindrical shoulder 138 of the mid plate 106 generally houses the regulating valve 134 and projects upward from the upward face 112 for receipt into the bore 136 when the rotary carburetor 20 is assembled. It would now be evident to one skilled in the art that the cylindrical shoulder 138 can be eliminated by orientating the regulating valve 134 generally further into the mid plate 106 thus creating a substantially planar upward face 112 of the mid plate 106.

The regulating valve 134 has an elongated arm 140 having a first end being in riding contact with a center projection 141 of the metering diaphragm 100 and a second end that carries a valve head 142 for sealing against an annular valve seat 144 supported by the cylindrical shoulder 138 of the mid plate 106 and generally communicating with the fuel channel 132 when the valve is open. The valve head 142 is normally biased against the valve seat 144 by a compression spring 146 compressed between the downward face 122 of the mid plate 106 and the pivoting arm 140 at a point preferably located between the first end and a pin 148 fixed to the mid plate 106 and about which the arm 140 pivots. When the regulating valve is open and fuel flows through the fuel channel 132 and into the metering chamber 98, the first end of the arm 140 that is urged upon the diaphragm by the spring 146, lowers with the downward flex of the metering diaphragm 100. This causes the opposite second end to move or pivot upward carrying the valve head 142 until it releasably seals against the valve seat 144 thereby placing the regulating valve 134 in a closed position. The regulating valve 134 remains closed and resists the force of the fuel pressure produced by the fuel pump assembly 40 until fuel exiting the metering chamber 98 reduces chamber pressure causing the pressure in the reference chamber 114 to exceed the pressure in the metering chamber 98. Once exceeded, (i.e. a sufficient differential pressure is created across the metering diaphragm) the metering diaphragm 100 flexes into the metering chamber 98 against any residual biasing force of the extended compression spring 146.

As best illustrated in FIG. 3, the fuel feed tube 69 communicates with the metering chamber 98 of the fuel metering chamber assembly 32 via a fuel passage 150 disposed at least in-part in the mid plate 106 of the main body 24. The fuel passage 150 has a lower leg portion 152 in the mid plate 106 that extends between inlet and outlet ports 154, 156 carried by the upward face 112 of the mid plate 106. The outlet port 156 is in liquid fuel communication with the fuel feed tube 69 in the annular collar 73 of the main body 24. The inlet port 154 generally receives fuel from an upper or second leg portion 158 of the fuel passage 150 in the base portion 58 of the main body 24 that is intersected by a high speed adjustment needle 27 preferably threaded to the base portion 58 of the body. The high speed adjustment needle 27 is preferably threaded to the base portion 58 of the body 24 for adjustably intersecting and obstructing the second leg portion 158 of the fuel passage 150 that communicates between the inlet port 154 of the lower or first leg portion 152 and a check valve 162 generally supported within a recess 164 defined by the upward face 112 of the mid plate 106. Check valve 162 operates to prevent the back flow of air and vapor into the metering chamber assembly 32 generally after engine shutdown. The check valve 162 preferably has a disc 164 that seats against an annular section of the upward face 112 in the recess 166 when pressure downstream exceeds the pressure in the metering chamber 98. The seat or annular section circles a supply port in the mid plate 106 that communicates directly with the metering chamber 98. When fuel is flowing out of the metering chamber 98, and through the open check valve 162, the disk 164 is in contact with a retainer 168 located in the recess 166 and having a plurality of downward projecting fingers that contact the disk 164 yet provide enough clearance to enable fuel flow.

As best shown in FIGS. 2 and 3, the air bypass screw 160 of the rotary carburetor 20 provides fine adjustment of the air/fuel ratio of the mixture flowing through the mixing passage 22 when the engine is idling. The air bypass screw 160 intersects a bypass passage 161 in the base portion 58 of the main body 24 that communicates directly between the upstream region 42 of the mixing passage 22 and the cylindrical cavity 48 or generally the downstream region 44. A threaded stem or shank 163 of the bypass screw 160 is mounted threadably to the base portion 58 and thereby moves a distal tip 165 of the screw 160 adjustably into and out of the air bypass passage 161 to adjust the flow of air that passes through the air bypass passage 161. When a portion of the incoming air is generally bypassed around the rotary throttle valve 28 via the bypass passage 161, the negative pressure in the through-bore 52 of the throttle 46 decreases and the amount of fuel ejection through the jet 71 decreases. Therefore, by adjusting the amount of the bypass air flow, it is possible to finely adjust the amount of fuel ejection at the time of idling. Preferably, when the rotary throttle valve 28 is in the fully open position and the engine is operating at higher speeds, the bypass passage 161 is cut-off by the base member 54 of the throttle 46.

As shown in FIG. 3, the bottom and mid plates 104, 106 of the main body 24 are attached to one another via a pair of short fasteners 170 preferably being threaded and orientated diagonally or at opposite corners of the plates, thus securing the metering chamber assembly 32 together with a substantially evenly distributed load. To receive and engage the short fasteners 170, the mid plate 106 has a pair of threaded blind bores 172 that axially align with a pair of non-threaded through-openings 174. The though-openings 174 provide a clearance fit for the fasteners 170 and preferably extend through the metering diaphragm or seal portion 100, the bottom plate 104 and the bracket 130.

The short fasteners 170 preferably include a head 176 and threaded shank 178 having a length such that upon fastening the mid plate 106 and bottom plate 104 together, the heads 176 engage the bracket 130 and the threaded shanks 178 are threaded within the threaded blind bores 172 of the mid plate 106, and preferably terminate therein. Accordingly, the short fasteners 170 preferably have a length equal to or less than the stacked height of the assembly 32. Thus, the bottom and mid plates 104, 106 can be attached to one another via the fasteners 170 independent from and without interfering with attachment of the fuel metering chamber assembly 32 to the air-fuel mixing or base portion 58 of the main body 24. Upon attaching the bottom and mid plates 104, 106 to one another via the short fasteners 170, the metering chamber 98 and atmospheric chamber 114 are substantially sealed by the force produced by the short fasteners 170 to prevent entry of contamination therein.

Figure 4:
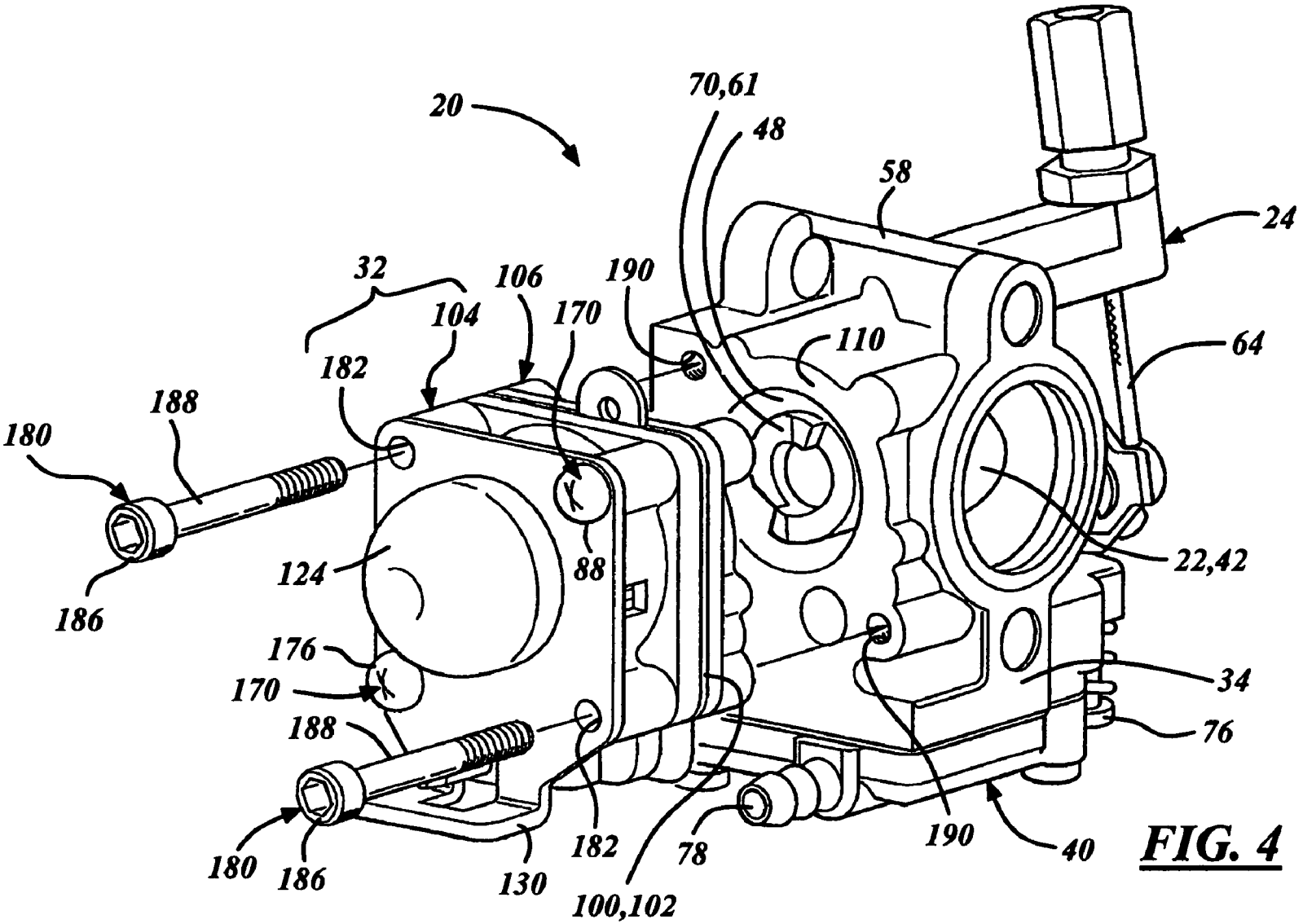
FIG. 4 is a partially exploded perspective view of the rotary carburetor.

As shown in FIGS. 4 and 5, the mid and bottom plates 106, 104 that generally house the fuel metering chamber assembly 32 are attached to the air-fuel mixing or base portion 58 via a pair of long fasteners 180 that are preferably threaded and located diagonally or opposite to one-another, and at adjacent corners to the short fasteners 170. The mid and bottom plates 106, 104 have respective through-openings 182, 184 adapted for corresponding axial and lateral alignment with one another and receipt of the long fasteners 180.

The long fasteners 180 have a head 186 and threaded shank 188 with a length such that upon locating the shanks 188 through the aligned through-openings 182, 184, the heads 186 engage the bracket 130 and the threaded shanks 188 extend beyond the mid plate 106 for threaded receipt in threaded blind bores 190 in the base portion 58 of the main body 24. Accordingly, the shanks 188 of the long fasteners 180 preferably have a length greater than the stacked height of the metering chamber assembly 32. As such, the fuel metering chamber assembly 32 can be attached to and removed from the base portion 58 without removing the short fasteners 170 attaching the mid and bottom plates 106, 104 to one another. It should be recognized that the long fasteners 180 could have a length equal to or less than the stacked height of the assembly 32 if a counterbore (not shown) were formed in the bottom plate 104 for receipt of the heads 186 of the fasteners 180 therein. In such a case, the bracket 130 could be fastened to the bottom plate 104 via additional fasteners, if desired.

To facilitate removal of the correct fasteners, 170, 180, preferably the fasteners have head configurations distinguishable from one another. For example, the short fasteners 170 are represented here as pan-head screws, while the long fasteners 180 are represented as hexagonal socket head cap screws.

Accordingly and as illustrated in FIGS. 3-4, when the annular collar 73 is formed rigidly to the mid plate 106 and removably closely fits into the cylindrical cavity 48 of base portion 58 of the main body 24, removal of the metering chamber assembly 32 from the base portion 58 by loosening the long fasteners 180 will conveniently expose the fuel feed tube 69 for maintenance and cleaning as it is removed from the base portion 58 with the assembly 32. Upon removing the fuel metering chamber assembly 32 from the base portion 58, the projecting fuel nozzle 69 can be easily cleaned without adversely exposing the metering diaphragm 100. For instance, pressurized air can be blown into the fuel nozzle 69 or the main fuel jet 71 where it will flow through the lower leg portion 152 of the fuel passage 150 in the mid plate 106 and exit the mid plate through the inlet port 154 carried by the upward face 112 of the mid plate 106 without exposing the metering diaphragm 100. This also isolates the metering diaphragm 100 from this pressurized air and damage thereby. Moreover the check valve 162 located in the recess 166 of the mid plate 106 can be easily removed from the fuel metering chamber assembly 32 for maintenance or replacement and without disturbing other components of the assembly 32. In general, while cleaning the fuel nozzle 38 or inspecting/replacing the check valve 162, any potential that contamination will enter the metering chamber 98 and/or the atmospheric chamber 114 is substantially reduced. In addition, the risk of damaging the internal components within the respective chambers 98, 114, such as the lever 54 or diaphragm 30, for example, is eliminated when cleaning the fuel nozzle 38 and maintaining the check valve 162.

As best illustrated in FIGS. 2 and 3, like the idle adjustment needle 65, the high speed adjustment needle 27 and the bypass screw 160 are accessible for adjustment from a common side of the carburetor 20 that is preferably the top surface 26. Preferably, the high speed adjustment needle 27 is elongated axially with respect to axis 50 and has a distal tip 192 that moves into and out of the upper leg portion 158 of the fuel passage 150 and a stem or shank having a threaded portion 194 that is threaded into the base portion 58 of the main body 24. By rotating the high speed adjustment needle 27 with the tool 67, the opening or flow area of the upper leg portion 158 of the fuel passage 150 receiving the tip 192 of the high speed adjustment needle 27 can be varied thus adjusting the volume of fuel flowing through the fuel passage 150 and into the mixing passage 22. Because the idle adjustment needle 65, the high speed adjustment needle 27 and the air bypass screw 160 are substantially parallel, positioning of the tool 67 to adjust the needles and screw is from the same direction. Therefore, the space between the carburetor 20 and surrounding structure needed for access of the adjustment tool 67 is only required from one side of the carburetor 20. This minimizes the restrictions on the layout of other components when the carburetor main body 24 is mounted on an engine.

Moreover, during manufacturing assembly, insertion of the idle and high speed adjustment needles 65, 27 and the air bypass screw 160 into the base portion 58 of the main body 24 is preferably also from the same direction or through the top surface 26 thus simplifying manufacturing by eliminating the need to rotate or reposition the carburetor 20 for each needle insertion. Preferably, both needles 65, 27 and the bypass screw 160 have a head 196 carrying a slot 198 exposed through the top surface 26 for receipt of the same tool 67 during end user adjustment. The idle adjustment needle 65 is protected from debris by a plug 200 press fitted into the hole 63 of the throttle shaft 56.

As previously described, the high speed adjustment needle 27 is preferably inserted through the top surface 26 during assembly and the throttle 46 is preferably inserted through the opposite downward face 110 of the base portion 58 of the main body 24. The modified carburetor illustrated in FIGS. 5 and 6 generally reverses this assembly while maintaining access for adjustment of the needles 27, 65 and bypass screw 160 through the top surface 26 with the needles and screw being substantially parallel to the axis 50. In the modified version, assembly of the high speed adjustment needle 27 utilizes a sleeve 202 of the body 24 preferably made of plastic that circumferentially encases and releasably grips the high speed adjustment needle 27 to reduce or eliminate unintended rotation of the needle. The sleeve 202 with the needle 27 threaded therein is snuggly inserted into a bore 204 in the base portion 58 of the body 24 through the downward face 110. Engagement of the fuel metering chamber assembly 32 to the base portion 58, as previously described, assists in preventing any axial shifting of the sleeve 202 and needle 27 out of the bore 204. The fuel passage 150 in the modified version of the carburetor 20 defines or carries in-part the upper leg portion 158 of the fuel passage 150. The lower leg portion 152 is located generally laterally between the upward face 112 of the mid plate 106 and the downward face 110 of the base portion 58 and is sealed and defined in-part by the gasket 108. As again illustrated in FIG. 5, the collar 73 is preferably unitary or one piece to the base portion 58 since the throttle 46 is inserted through the top surface. However, one skilled in the art would now understand that the collar 73 need not be unitary to the base portion 58 if cleaning of the fuel feed tube 69 is desired upon removal of the fuel metering chamber assembly 32.

While the forms of the invention herein disclosed constitute presently preferred embodiments, others will be readily recognized by those skilled in the art. It is not intended herein to mention all the possible equivalent forms or ramifications of the invention. It is understood that terms used herein are merely descriptive, rather than limiting, and that various changes may be made without departing from the spirit or scope of the invention. The invention is defined by the following claims.

We claim:

1. A rotary carburetor having a rotary throttle valve constructed and arranged to rotate about and move axially along an axis for simultaneously adjusting both an opening air flow area of a mixing passage through a body and adjusting the quantity of liquid fuel flowing into the mixing passage, the rotary carburetor comprising:

an external surface of the body generally facing a common axial direction;

the rotary throttle valve having an idle adjustment needle having an axis and a head exposed axially through the external surface;

a high speed adjustment needle having an axis parallel to the axis of the idle adjustment needle, a head exposed axially through the external surface and an opposite tip for adjustably obstructing a fuel passage communicating with the mixing passage; and an adjustable air bypass valve with an axis parallel to the axis of the idle adjustment needle and a head exposed axially through the external surface.

2. The rotary carburetor set forth in claim 1 further comprising:

the body having a base portion carrying the mixing passage, an outer plate and a mid plate layered between the base portion and the outer plate; and a fuel metering chamber assembly integrated into the mid and outer plates, the fuel metering chamber assembly having:

at least one first fastener, a diaphragm compressed axially with respect to the axis between the mid and bottom plates by the at least one first fastener, a metering chamber defined between the mid plate and a wet side of the diaphragm, a reference chamber defined between an opposite dry side of the diaphragm and the outer plate, and at least one second fastener extending axially and attaching the mid plate, outer plate and diaphragm to the base portion independently from said at least one first fastener attaching the mid and outer plates together, said fuel metering chamber assembly being removable from said base portion without removing said at least one first fastener.

3. The rotary carburetor set forth in claim 2 further comprising:

a flanking plate of the body engaged to the base portion and disposed perpendicular to the mid and outer plates;

a fuel pump assembly integrated between the base portion and the flanking plate; and a fuel channel in the base portion for flowing fuel from the fuel pump assembly to the metering chamber.

4. The rotary carburetor set forth in claim 1 further comprising:

the body having a base portion defining the mixing passage and carrying the external surface;

a face of the base portion facing in an opposite direction to the external surface;

a fuel metering chamber assembly sealed to and being in fluid communication through the face; and a cylindrical cavity opened through the face for rotatable receipt of the rotary throttle valve.

5. A rotary carburetor having a rotary throttle valve constructed and arranged to rotate about and move axially along an axis for simultaneously adjusting both an opening air flow area of a mixing passage through a body and adjusting the quantity of liquid fuel flowing into the mixing passage, the rotary carburetor comprising:

an external surface of the body generally facing a common axial direction;

the rotary throttle valve having an idle adjustment needle having an axis and a head exposed axially through the external surface;

a high speed adjustment needle having a head exposed axially through the external surface and an opposite tip for adjustably obstructing a fuel passage communicating with the mixing passage; and an air bypass screw extending axially between a head and a tip of the air bypass screw and the head is exposed axially through the external surface.

6. The rotary carburetor set forth in claim 5 wherein the tip of the air bypass screw adjustably obstructs an air bypass passage in the body that communicate at both ends with the mixing passage and generally bypasses the rotary throttle valve when in an idle position.

7. The rotary carburetor set forth in claim 5 wherein the idle adjustment needle, the high speed adjustment needle and the air bypass screw are substantially parallel to the axis and project in the same direction.

8. The rotary carburetor set forth in claim 7 wherein the idle adjustment needle is threaded to a cylindrical throttle of the rotary throttle valve being rotatable with respect to the body, and the high speed adjustment needle and the air bypass screw are threaded to the body.

9. The rotary carburetor set forth in claim 5 further comprising:

a cylindrical cavity intersecting the mixing passage in the body;

the rotary throttle valve having:

a cylindrical throttle disposed rotatably in the cylindrical cavity about the axis, a through-bore in the cylindrical throttle and orientated for adjustable longitudinal alignment to the mixing passage, and the idle adjustment needle mounted to the cylindrical throttle, projecting axially adjustably into the through-bore and disposed concentrically to the axis, and a fuel feed tube engaged to the body, disposed concentrically to the axis, and projecting into the through-bore for receipt of the idle adjustment needle, the fuel feed tube having a cylindrical wall and an orifice communicating through the wall and orientated to be variably obstructed by the idle adjustment needle for controlled flow of liquid fuel from the fuel passage, through the fuel feed tube and into the through-bore.

10. The rotary carburetor set forth in claim 9 wherein the idle adjustment needle is threaded to the cylindrical throttle for axial adjustment with respect to the axis into the through-bore and the high speed adjustment needle and the air bypass screw are threaded to the body.

11. The rotary carburetor set forth in claim 5 further comprising an idle adjustment screw disposed generally over the external surface and constructed and arranged to contact a throttle lever of the rotary throttle valve when in the idle position.

12. The rotary carburetor set forth in claim 11 wherein the idle adjustment screw is disposed perpendicular to the axis.

13. A rotary carburetor having a rotary throttle valve constructed and arranged to rotate about and move axially along an axis for simultaneously adjusting both an opening air flow area of a mixing passage through a body and the flow of liquid fuel into the mixing passage, the rotary carburetor comprising:

the body having an external first surface on one side;

a cylindrical cavity intersecting the mixing passage in the body;

the rotary throttle valve having:

a cylindrical throttle disposed rotatably in the cylindrical cavity about an axis, a through-bore in the cylindrical throttle and orientated for adjustable longitudinal alignment to the mixing passage, and an idle adjustment needle mounted to the cylindrical throttle, projecting axially adjustably into the through-bore and disposed concentrically to the axis, the idle adjustment needle having a head exposed through the external side;

a fuel feed tube engaged to the body, disposed concentrically to the axis, and projecting into the through-bore for receipt of the idle adjustment needle, the fuel feed tube having a cylindrical wall and an orifice communicating through the wall and orientated to be variably obstructed by the idle adjustment needle for controlled flow of liquid fuel through the fuel feed tube and into the through-bore;

an air bypass passage communicating with the mixing passage downstream of the rotary throttle valve; and an adjustable air bypass valve for adjusting air flow through the air bypass passage into the mixing passage and having an axis parallel to the axis of the throttle valve and a head exposed axially through the first surface for adjusting the air bypass valve.

14. The rotary carburetor set forth in claim 13 wherein the idle adjustment needle is threaded to the cylindrical throttle for axial adjustment with respect to the axis into the through-bore.

15. The rotary carburetor set forth in claim 14 which also comprises a high speed adjustment needle, having a head exposed through the first surface for adjusting the quantity of fuel flowing to the fuel feed tube.

16. The rotary carburetor set forth in claim 15 wherein the idle adjustment needle and the high speed adjustment needle are elongated and disposed parallel to one another.

17. The rotary carburetor set forth in claim 15 further comprising a fuel passage in the body and communicating between the fuel feed tube and a fuel supply source with the high speed adjustment needle adjustably and obstructively intersecting the fuel passage for controlling liquid fuel flow into the fuel feed tube.

18. The rotary carburetor set forth in claim 17 further comprising:

an air bypass passage in the body and communicating between the mixing passage upstream of the rotary throttle valve and the cylindrical cavity downstream of the fuel feed tube; and an air bypass screw mounted adjustably to the body for movement into and out of the air bypass passage, and projecting outwardly though the external side.

19. The rotary carburetor set forth in claim 17 wherein the fuel passage communicates between the fuel feed tube and a metering fuel chamber in the body and the rotary carburetor is a diaphragm type.

20. The rotary carburetor set forth in claim 13 wherein the external first surface is a top surface.

21. The rotary carburetor set forth in claim 13 further comprising:

the body having a base portion carrying the mixing passage, an outer plate and a mid plate layered between the base portion and the outer plate; and a fuel metering chamber assembly integrated into the mid and outer plates, the fuel metering chamber assembly having:

at least one first fastener, a diaphragm compressed axially with respect to the axis between the mid and bottom plates by the at least one first fastener, a metering chamber defined between the mid plate and a wet side of the diaphragm, a reference chamber defined between an opposite dry side of the diaphragm and the outer plate, and at least one second fastener attaching the mid plate, outer plate and diaphragm to the base portion independently from said at least one first fastener attaching the mid and outer plates together, said fuel metering chamber assembly being removable from said base portion without removing said at least one first fastener.

22. A rotary carburetor having a rotary throttle valve constructed and arranged to rotate about and move axially along an axis for simultaneously adjusting both an opening air flow area of a mixing passage through a body and the flow of liquid fuel into the mixing passage, the rotary carburetor comprising:

the body having an external first surface on one side;

a cylindrical cavity intersecting the mixing passage in the body;

the rotary throttle valve having:

a cylindrical throttle disposed rotatably in the cylindrical cavity about an axis, a through-bore in the cylindrical throttle and orientated for adjustable longitudinal alignment to the mixing passage, and an idle adjustment needle mounted to the cylindrical throttle, projecting axially adjustably into the through-bore and disposed concentrically to the axis, the idle adjustment needle having a head exposed through the external side;

a fuel feed tube engaged to the body, disposed concentrically to the axis, and projecting into the through-bore for receipt of the idle adjustment needle, the fuel feed tube having a cylindrical wall and an orifice communicating through the wall and orientated to be variably obstructed by the idle adjustment needle for controlled flow of liquid fuel through the fuel feed tube and into the through-bore;

a high speed adjustment needle having a head exposed through the first surface for adjusting the quantity of fuel flowing to the fuel feed tube;

an air bypass passage in the body and communicating between the mixing passage upstream of the rotary throttle valve and generally the mixing passage downstream of the rotary throttle valve; and an air bypass screw mounted adjustably to the body for movement into and out of the air bypass passage, and exposed though the external first surface.

23. The rotary carburetor set forth in claim 22 wherein the high speed adjustment needle and the air bypass screw are elongated and extend parallel to the axis.

24. The rotary carburetor set forth in claim 22 further comprising an idle adjustment screw disposed generally over the external first surface and constructed and arranged to contact a throttle lever of the rotary throttle valve when in the idle position.

25. A rotary carburetor comprising:

a body having a mixing passage through the body and an external surface of the body;

a rotary throttle valve constructed and arranged to rotate about an axis and to move axially along the axis for simultaneously adjusting an opening air flow area of the mixing passage and the quantity of liquid fuel flowing into the mixing passage;

an idle adjustment needle carried by the rotary throttle valve and having an axis parallel to the axis of the rotary throttle valve and a head exposed axially through the external surface for adjusting the idle adjustment needle;

an adjustable air bypass valve having an axis parallel to the axis of the rotary throttle valve and a head exposed axially through the external surface for rotation to adjust the air bypass valve; and a high speed fuel flow adjustment valve carried by the body and having an axis parallel to the axis of the rotary throttle valve and a head exposed axially through the external surface for rotation to adjust the quantity of fuel supplied to the mixing passage.

* * * * *